US007108593B2

(12) United States Patent
Janson

(10) Patent No.: US 7,108,593 B2
(45) Date of Patent: Sep. 19, 2006

(54) POWER TOOL ADJUSTABLE HANDLE ASSEMBLY

(75) Inventor: John Clayton Janson, East Dundee, IL (US)

(73) Assignee: WMH Tool Group, Inc., Elgin, IL (US)

( * ) Notice: Subject to any disclaimer, the term of this patent is extended or adjusted under 35 U.S.C. 154(b) by 0 days.

(21) Appl. No.: 10/979,718

(22) Filed: Nov. 2, 2004

(65) Prior Publication Data

US 2005/0153637 A1 Jul. 14, 2005

Related U.S. Application Data

(60) Provisional application No. 60/517,321, filed on Nov. 3, 2003.

(51) Int. Cl.
*B26B 7/00* (2006.01)

(52) U.S. Cl. ..... 451/357; 451/359; 16/430; 16/900

(58) Field of Classification Search ..... 451/357, 451/359, 344; 16/430, 438, 900
See application file for complete search history.

(56) References Cited

U.S. PATENT DOCUMENTS

| | | | | |
|---|---|---|---|---|
| 183,343 | A | | 3/1876 | Sweeney et al. |
| 910,813 | A | | 1/1909 | Heer |
| 1,874,232 | A | | 8/1932 | Groene et al. |
| 3,058,386 | A | | 10/1962 | Morrow |
| 3,348,254 | A | | 10/1967 | Storm, Jr. et al. |
| 3,928,947 | A | | 12/1975 | Millett |
| 3,986,409 | A | | 10/1976 | Tripp et al. |
| 4,186,905 | A | | 2/1980 | Brudy |
| 4,188,682 | A | | 2/1980 | Burglin et al. |
| 4,239,428 | A | | 12/1980 | Berzina |
| 4,517,700 | A | | 5/1985 | Pinto |
| 4,643,263 | A | * | 2/1987 | Karden ..... 173/168 |
| 4,727,618 | A | | 3/1988 | Mahoney |
| D295,253 | S | | 4/1988 | Ashworth |
| 4,791,694 | A | | 12/1988 | Itaya et al. |
| 4,891,915 | A | | 1/1990 | Yasuda |
| 4,938,642 | A | | 7/1990 | Imahashi et al. |
| 4,962,617 | A | | 10/1990 | Tilders et al. |
| D312,714 | S | | 12/1990 | Simonelli et al. |
| 5,062,179 | A | | 11/1991 | Huang |
| 5,070,576 | A | | 12/1991 | Banta |
| 5,154,435 | A | | 10/1992 | Chiu |
| 5,168,601 | A | | 12/1992 | Liu |

(Continued)

OTHER PUBLICATIONS

5" Random Orbit Dustless Sander/Polisher Kit, Model 3283DVSK, on p. 116 of the Bosch Precision Power Tools and Accessories Catalog, 1992, 4 pages.

(Continued)

*Primary Examiner*—Jacob K. Ackun, Jr.
(74) *Attorney, Agent, or Firm*—Fitch, Even, Tabin & Flannery

(57) ABSTRACT

A power tool is provided with an adjustable handle assembly. The assembly has a housing and a handle connected to the housing. The handle may be movable between a plurality of positions and has a gripping portion. There may be a lock member associated with either of the movable handle or the housing. The other of the handle and the housing would have a mating member that cooperates with the lock member to lock the handle in position. The assembly may be provided with an actuator movable between a lock position to lock the handle and an unlock position to allow the handle to be moved. The handle may extend from a rear portion of the housing.

39 Claims, 12 Drawing Sheets

U.S. PATENT DOCUMENTS

| | | | | | |
|---|---|---|---|---|---|
| 5,231,727 | A | | 8/1993 | Armbruster | |
| 5,269,045 | A | | 12/1993 | DeSerio et al. | |
| 5,289,605 | A | | 3/1994 | Armbruster | |
| 5,309,594 | A | | 5/1994 | Thompson | |
| 5,357,715 | A | * | 10/1994 | Hiramatsu | 451/357 |
| 5,371,919 | A | | 12/1994 | Winkler | |
| 5,466,183 | A | | 11/1995 | Kirn et al. | |
| 5,520,474 | A | | 5/1996 | Liu | |
| 5,709,596 | A | * | 1/1998 | Alexander et al. | 451/357 |
| 5,775,657 | A | | 7/1998 | Hung | |
| 5,806,453 | A | | 9/1998 | Cook | |
| 5,813,805 | A | | 9/1998 | Kopras | |
| 6,266,850 | B1 | | 7/2001 | Williams et al. | |
| 6,499,172 | B1 | | 12/2002 | McCracken | |
| 6,725,491 | B1 | * | 4/2004 | Hung | 15/97.1 |
| 2003/0228833 | A1 | * | 12/2003 | Boyer | 451/344 |

OTHER PUBLICATIONS

5" Random Orbit Sander Model No. 3283 DVS, Exploded View and Parts List, Bosch, Jun. 1990, 2 pages.

* cited by examiner

POWER TOOL ADJUSTABLE HANDLE ASSEMBLY

CROSS-REFERENCE TO RELATED APPLICATION

This application claims benefit of U.S. Provisional Application No. 60/517,321, filed Nov. 3, 2003, which is hereby incorporated herein by reference in its entirety.

BACKGROUND OF THE INVENTION

This invention relates generally to a power tool adjustable handle assembly and, more particularly, to an electrically-powered polisher capable of rotating a pad to polish a workpiece.

The tool industry offers a variety of power tools for performing work on various types of workpieces. These power tools, however, have a variety of shortcomings from both the consumer and the operator's perspective. From the consumer's perspective, one common shortcoming is that power tools do not offer a variety of effective positions with which an operator may grasp the power tool. For example, many power tools have stationary handles with which the operator is to grasp the power tool (e.g., one forward handle and one rearward handle, two side handles, etc.). Although the stationary handle configuration may make it comfortable to operate the tool in a particular position or to perform a specific task, it may also make it uncomfortable to operate the tool in another position or to perform a different task. Thus, by limiting the operator in this way, the power tool may become less comfortable to work with and more difficult to use for extended periods of operation.

Another consumer shortcoming is that current power tool configurations can force the operator to hold and actuate the power tool in a specific manner or with a specific hand arrangement, rather than provide the operator with the freedom to hold and actuate the tool as desired. For example, as mentioned above, some power tools may require the operator to hold a forward handle with one hand and a rearward handle with another. This configuration may force the operator to operate the power tool using a hand arrangement he or she does not feel comfortable using, or may force the operator to hold the tool in an uncomfortable manner so that the operator can operate the power tool with a hand arrangement that feels most comfortable.

Yet another consumer shortcoming is that existing power tools do not offer handles with enhanced gripping surfaces for an operator to use to grip the tool. For example, many power tools, such as polishers, are used outdoors in hot climates where operation of the tool often causes the operator to sweat, and possibly even involve operation of the tool in damp environments, such as, for example, near a recently washed vehicle. This often results in the operator having a difficult time in gripping and/or controlling the power tool due to a lack of enhanced gripping surfaces.

From a manufacturer's perspective, a common shortcoming with current power tools is that they are difficult to pack and ship from one location to another. For example, many tools have stationary handles that increase the size of the product and its packaging. This may result in a reduction of the number of units that can be shipped at one time which, in turn, can increase the cost of a tool due to the added costs associated with multiple shipments.

Thus, there is a need for a power tool adjustable handle assembly offering a variety of effective positions with which an operator may grasp the power tool, thereby providing freedom to hold and actuate the tool as desired, and providing a power tool which is easy to pack and ship.

BRIEF DESCRIPTION OF THE DRAWINGS

FIGS. 1I–J are cross sectional views of the power tool of FIG. 1A, taken along the vertical reference plane of the power tool;

DESCRIPTION OF THE PREFERRED EMBODIMENTS

Figure 1A:
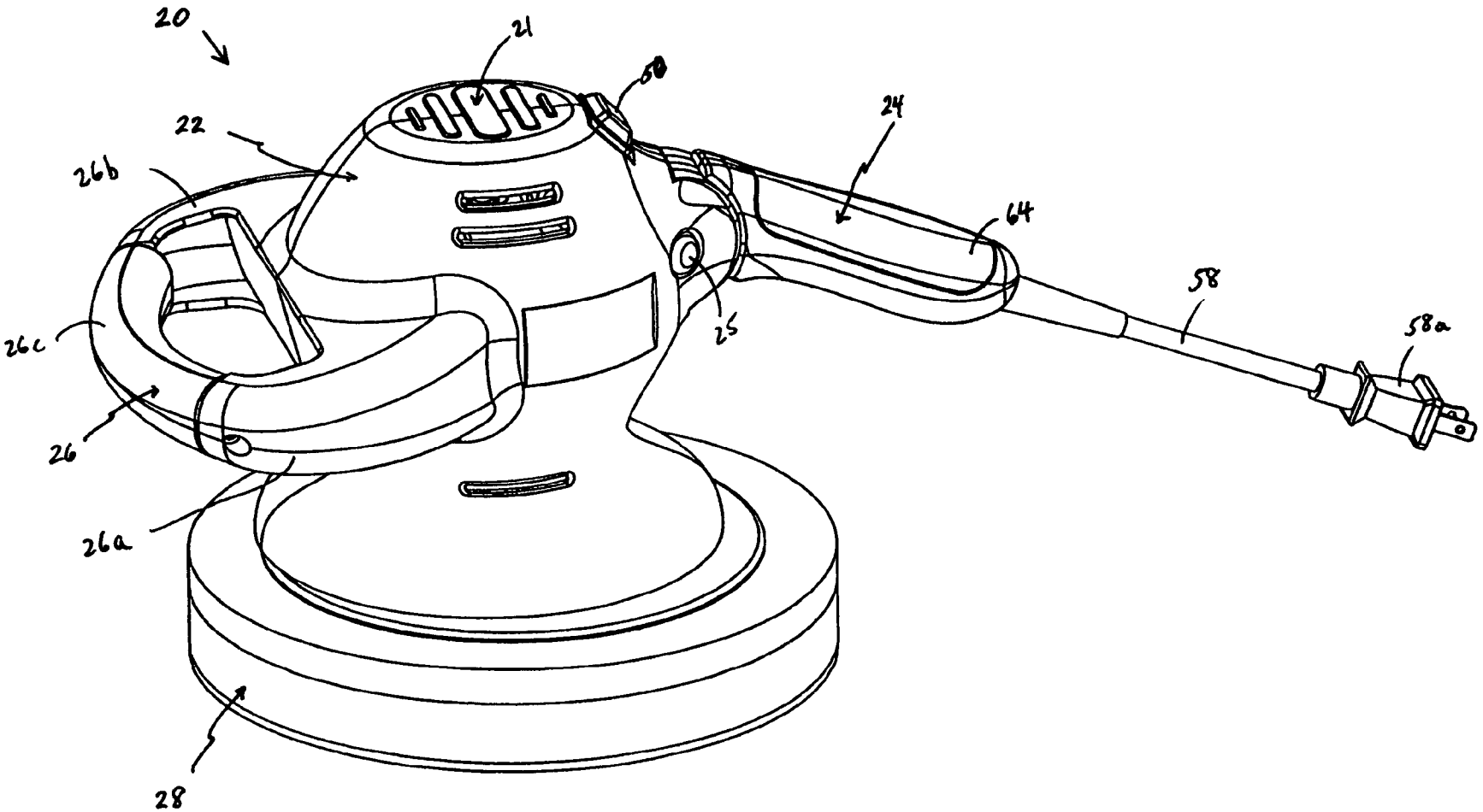
FIG. 1A is a perspective view of a power tool embodying features of the present invention.
Figure 1C:
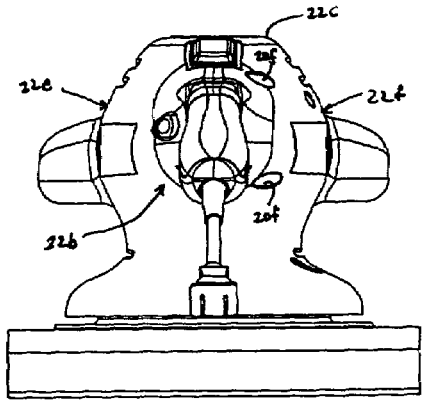
FIGS. 1B–C are front and rear elevational views, respectively, of the power tool of FIG. 1A.
Figure 1B:
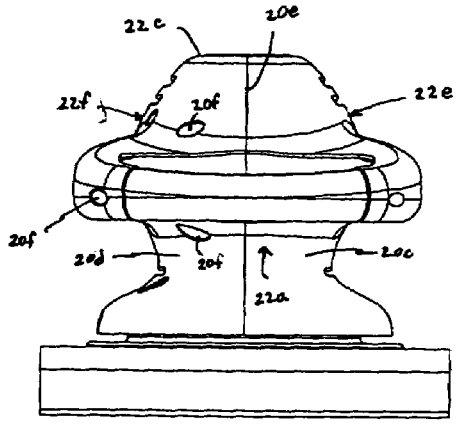
Figure 1D:
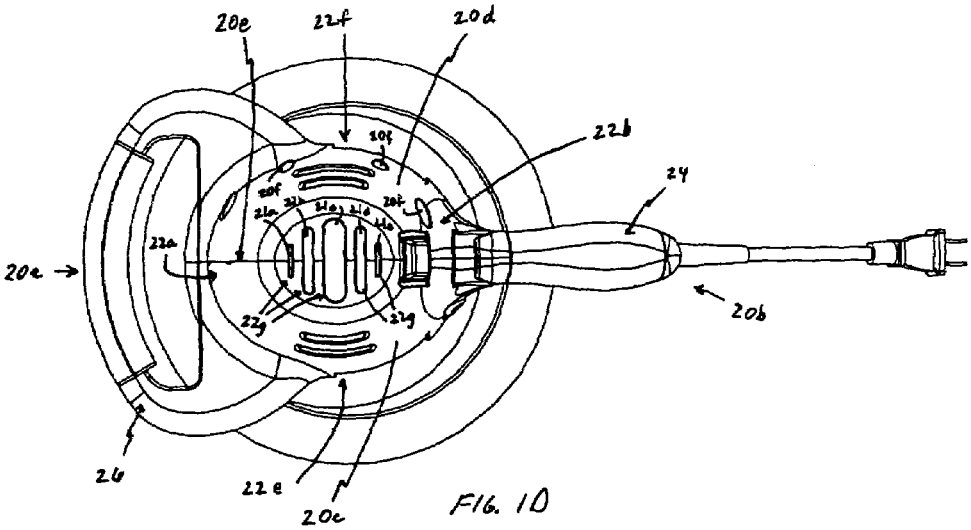
FIG. 1D is a plan view of the power tool of FIG. 1A.
Figure 1E:
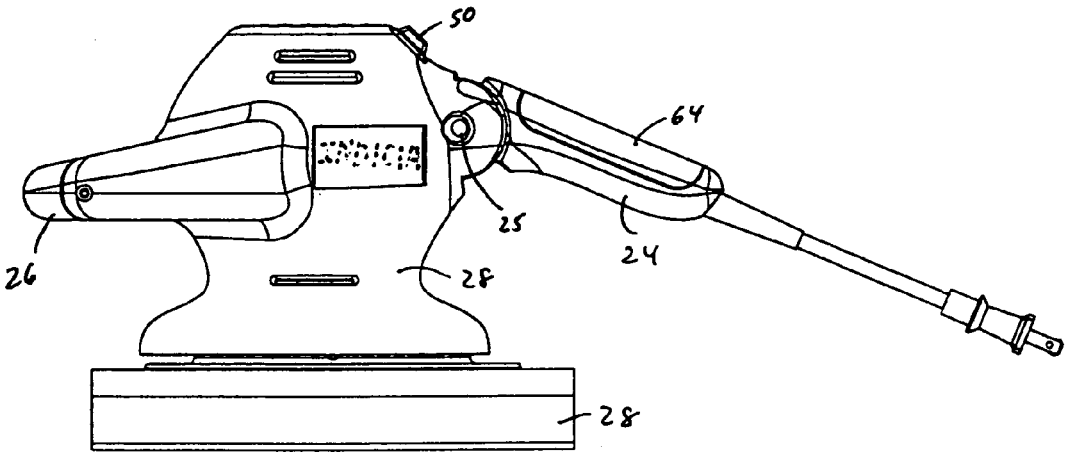
FIGS. 1E–F are left and right side elevational views, respectively, of the power tool of FIG. 1A.
Figure 1F:
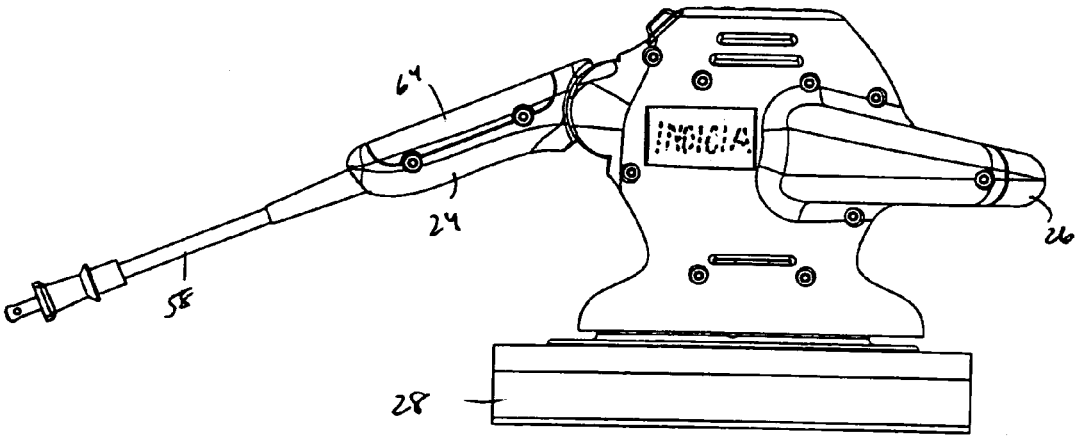
Figure 1G:
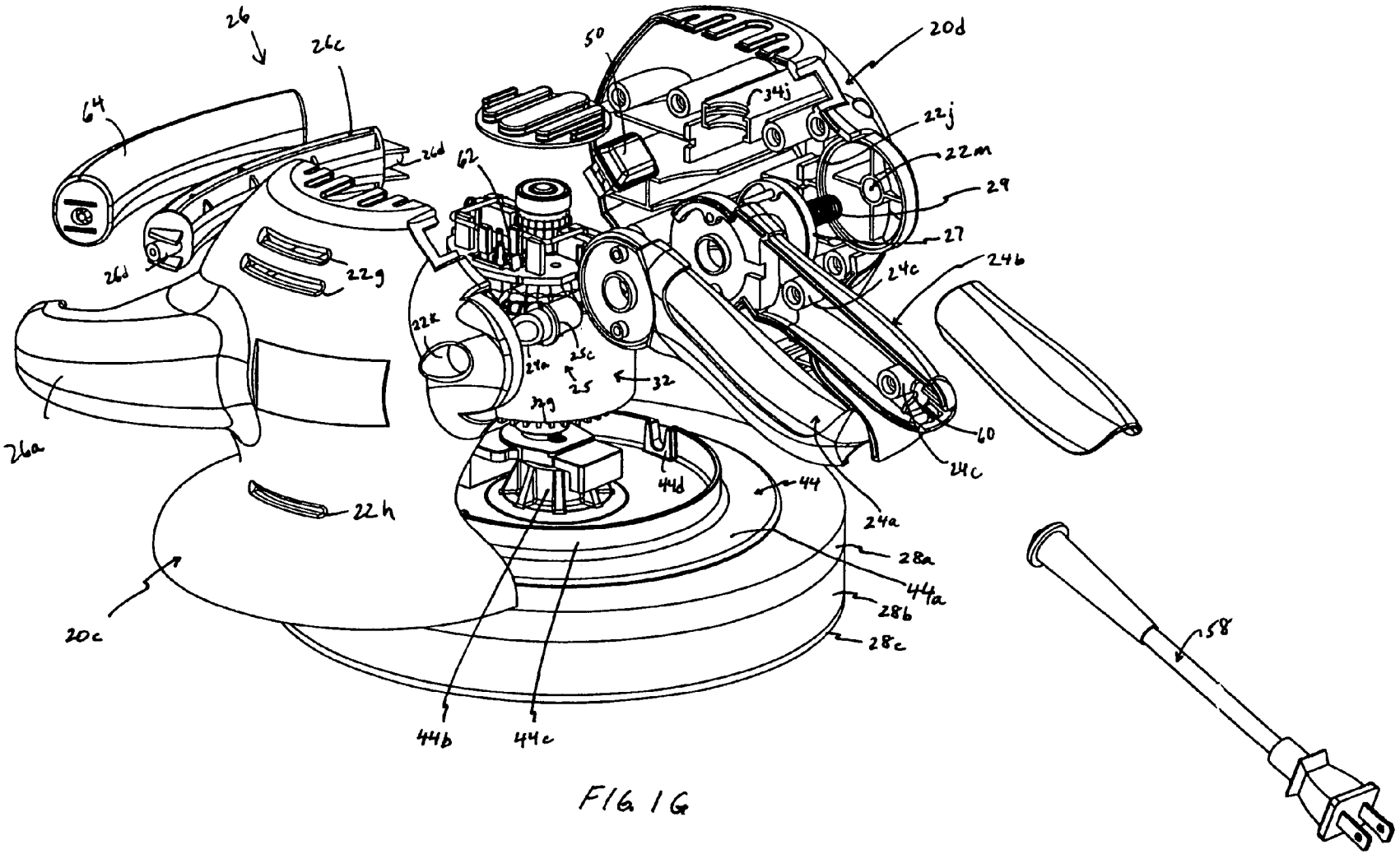
FIG. 1G is a partially exploded view of the power tool of FIG. 1A, taken from the left side of the tool.
Figure 1H:
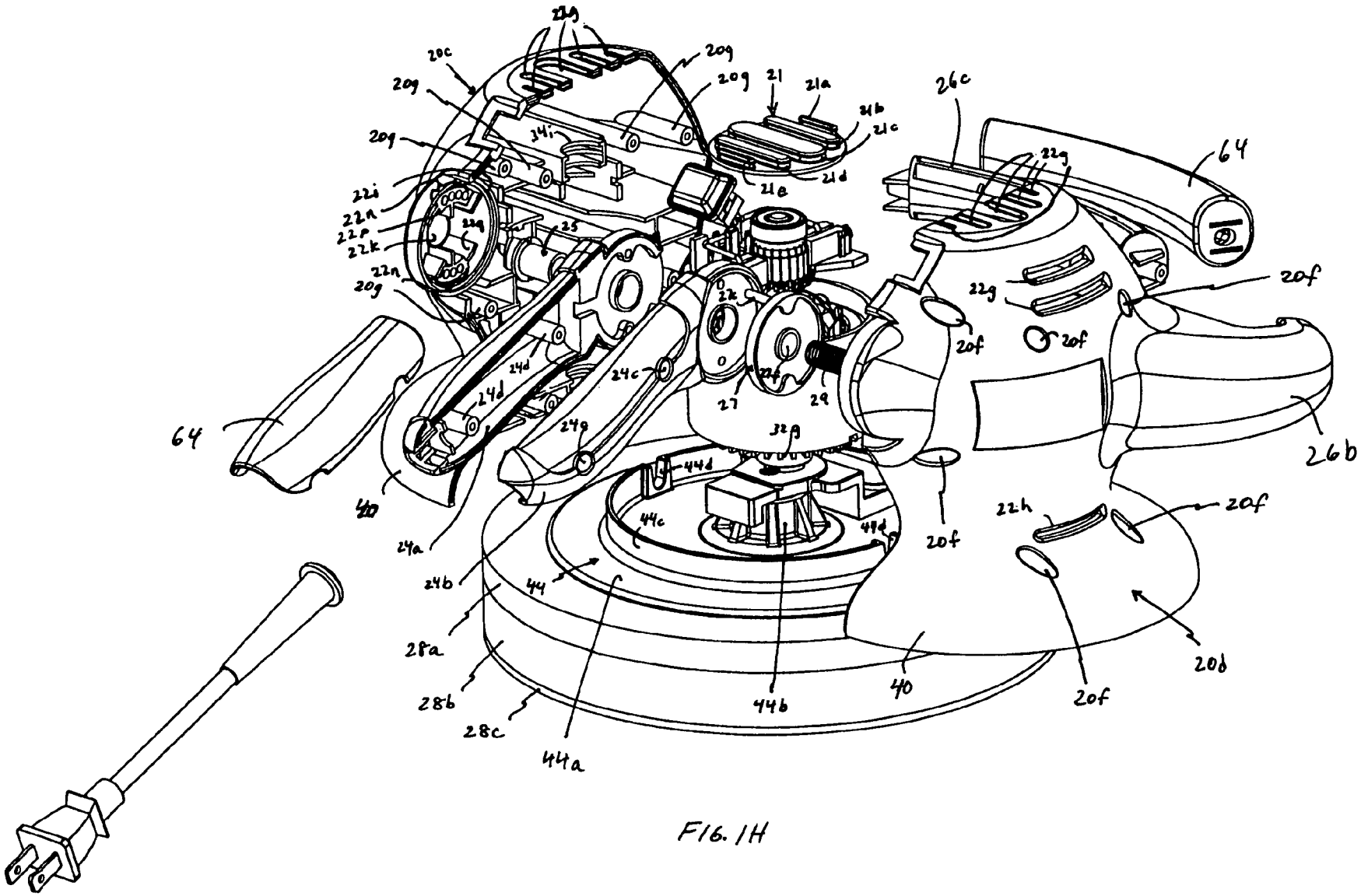
FIG. 1H is a partially exploded view of the power tool of FIG. 1A, taken from the right side of the tool.
Figure 11:
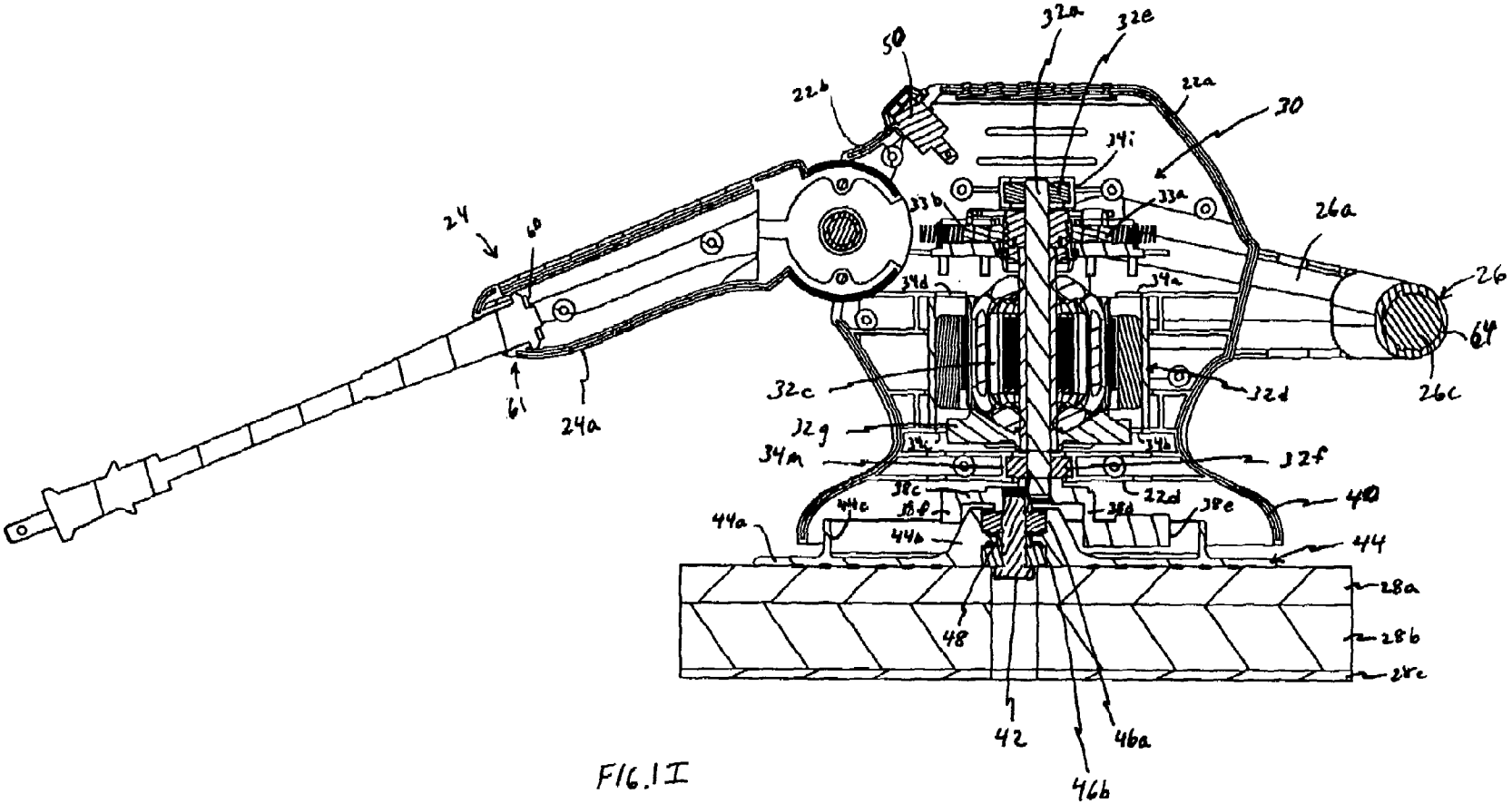

In FIGS. 1A–H, there is illustrated a power tool 20 embodying features of the present invention for working (e.g., waxing, buffing, polishing, etc.) on a workpiece. The power tool 20 includes a housing 22, first and second handles 24 and 26, respectively, connected to the housing 22, and a work element, such as a pad 28, for working on a desired workpiece, such as the body of an automobile or hull of a boat. The power tool 20 includes a symmetrical design about a vertical reference plane (not shown) extending centrally from the forward end of the tool 20*a* to a rearward end 20*b* (see FIG. 1D). The exploded views illustrated in FIGS. 1G and H show the housing 22 separated along the vertical reference plane.

In a preferred embodiment, the housing 22 and handles 24 and 26 of tool 20 have clamshell designs with a first clamshell member 20*c* and a second clamshell member 20*d* which, when connected to each other, define a parting line 20*e* which extends in the vertical reference plane about which the tool 20 is generally symmetrical, as shown in FIG.

1D. The clamshell members 20*c* and 20*d* are secured together by a number of screws (not shown) which are recessed into bores 20*f* defined by second clamshell member 20*d* and thread into internally threaded bores or post members 20*g* defined by first clamshell member 20*c*. The clamshell members 20*c* and 20*d* can be made of any suitably lightweight material and, in a preferred embodiment, are molded plastic parts.

As illustrated in FIGS. 1A–F, the housing 22 is generally round in shape and includes front portion 22*a*, rear portion 22*b*, top portion 22*c*, and bottom portion 22*d* (FIGS. 1H–J), and first and second side portions 22*e–f*, respectively. Collectively the housing portions 22*a–f* define an internal cavity 30 within which at least a portion of motor 32 (FIGS. 1G and H) is disposed. The first handle 24 extends from the rear portion 22*b* of housing 22 and the second handle 26 extends from the front portion 22*a* and/or side portions 22*e–f* of housing 22. The upper portion 22*c* and bottom portion 22*d* of housing 22 form generally flat surfaces, and the edges of the housing 20 are generally rounded or arcuate to reduce or eliminate the number of sharp edges and facilitate a generally smooth transition from one housing portion to another. For example, the edges between top portion 22*c* and the front, rear and side portions 22*a–b* and 22*e–f*, are rounded as illustrated in FIGS. 1C–D and 1E–F.

The upper portion 22*c* of housing 22 defines an opening through which a pad may extend to provide a resilient surface for resting the tool 20 on while not in use and/or while performing work on the work element 28 (e.g., replacing or interchanging bonnets, applying polish to the pad 28, etc.). In the embodiment illustrated in FIGS. 1D, G and H, a plurality of openings 22*g* are defined by the upper portion 22*c* of housing 22. The openings 22*g* are oblong in shape and are parallel to one another, extending laterally over the upper surface of the power tool 20 and perpendicular to the vertical reference plane of the tool 20. The pad 21 has a generally circular shaped base with a plurality of ridges 21*a–e* extending from a surface thereof. The ridges 21*a–e* form oblong shapes which are complimentary to the openings 22*g* and have generally flat and coplanar upper surfaces. In a preferred form, the pad 21 is made of an elastomeric material such as rubber. When assembled, the ridges 21*a–e* extend through the openings 22*g*, above the upper portion 22*c* of housing 22, to provide a frictional surface upon which the tool 20 may be rested.

As mentioned above, and illustrated in FIGS. 1G–J, the housing portions 22*a–f* define a cavity within which motor 32 is disposed. The motor has a shaft 32*a* with a commutator 32*b*, a rotor armature 32*c* and a stator 32*d*. Brushes 33*a–b* are connected to the commutator 32*b* to provide an electrical connection between the rotating armature 32*c* and the terminals 32*d* of motor 32. Bearings 32*e–f* are situated on generally opposite ends of the motor shaft 32*a* and assists the motor in operating more efficiently by aligning and guiding the rotational operation of the shaft 32*a* and reducing the frictional forces encountered thereby.

The motor 32 is secured into position and/or aligned by ribs 34 which extend from the inner surface of at least one of the housing portions 22*a–f*. In the embodiment illustrated, ribs 34*a, b, c* and *d* of left clam shell member 20*c* (FIG. 1I) and ribs 34*e, f, g* and *h* of right clam shell member 20*d* (FIG. 1J) form corner brackets (or collectively a slot) within which the stator yoke 33*d* is nested. In addition, ribs 34*i* (FIG. 1I) and 34*j* (FIG. 1J) form a slot or socket within which the upper bearing 32*e* is disposed. Similarly, ribs 34*m* (FIG. 1I) and 34*n* (FIG. 1J) form a slot or socket adjacent the bottom portion 22*d* within which the lower bearing 32*f* is disposed. In a preferred embodiment, several of the ribs also include an arcuate edge that compliments the body of the motor 32. This helps align the motor 32 and prevent vibration due to component rattling.

A fan 32*g* is positioned on, and driven by, the motor shaft 32*a* in order to circulate air through, and cool, the motor 32. The housing 22 defines vents to assist in the circulation of air through the tool 20. For example, in the embodiment illustrated in FIGS. 1A–J, the motor 32 rotates the fan 32*g* in order to draw air through the upper vents 22*g* located in the housing, down over the armature 32*c* and stator 32*d*, and out the lower vents 22*h* located in the housing 22. The circulation of air cools the motor 32 during operation, which aids in preventing the motor 32 from overheating.

Figure 1J:
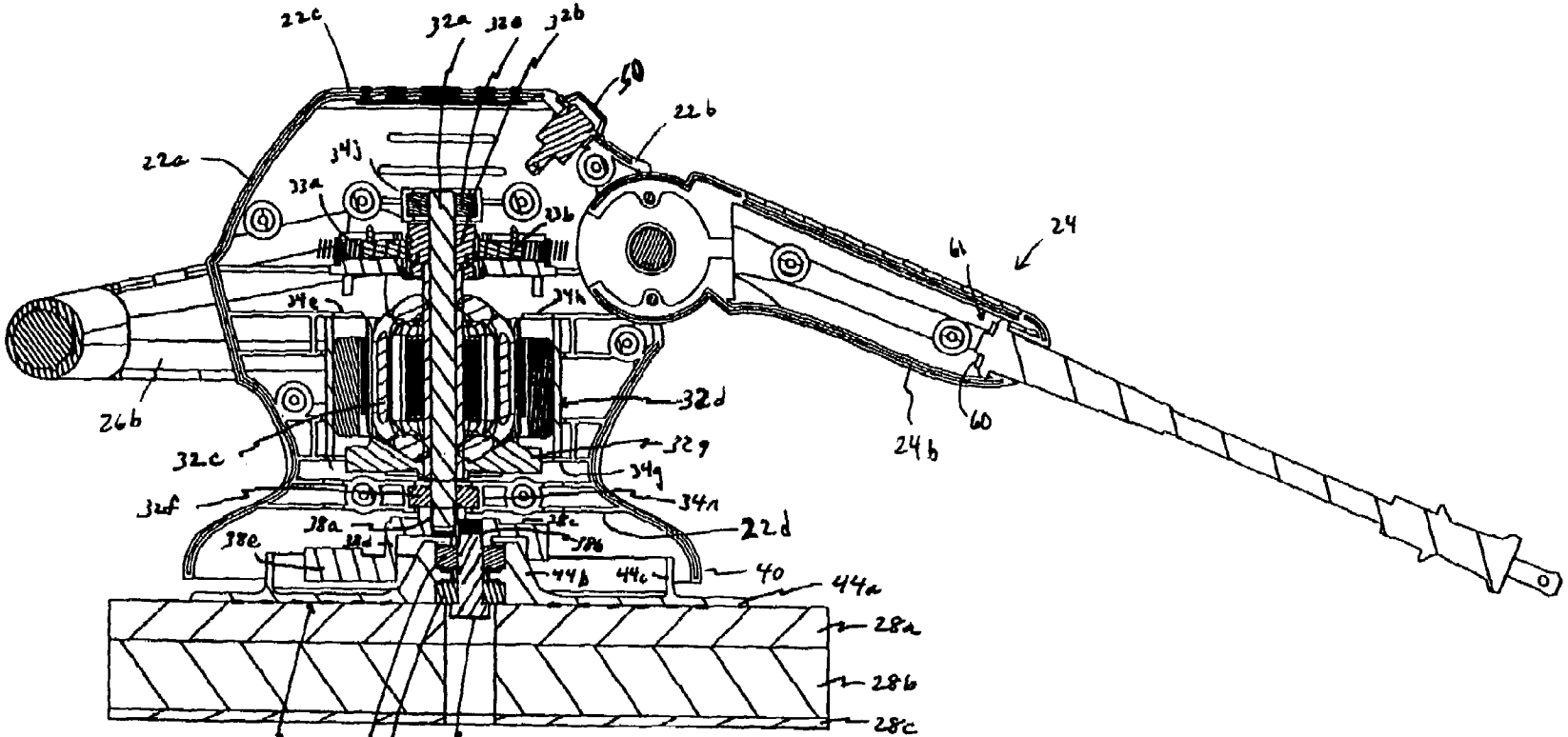

As illustrated in FIGS. 1I and 1J, a portion of the motor shaft 32*a* extends down through lower bearing member 32*f* and through an opening defined by the bottom portion 22*d*. The exposed portion of the motor shaft 32*a* serves as the output shaft for driving a work element. In the illustrated polisher embodiment, the output shaft of power tool 20 is connected to, and drives, a counterweight 38 to orbitally rotate a work element, such as polisher pad 28, below the housing 22. More particularly, the motor output shaft 32*a* extends through the bottom portion 22*d* of housing 22 and is threaded into a first threaded bore 38*a* defined by the counterweight 38. As illustrated in FIGS. 1G–J, the counterweight 38 is connected to the pad assembly 28 by a bolt, such as left handed bolt 42, which threads into a second threaded bore 38*b* in the counterweight 38. The second counterweight bore 38*b* is parallel to, and located generally adjacent to, the first counterweight bore 38*a*. Thus, rotation of the output shaft 32*a* results in a corresponding rotation in the counterweight 38 and the pad assembly 28 connected thereto.

Extending downward below the housing 22 is an arcuate shield or skirt member 40, which forms an annular wall about the exposed end of the motor shaft 32*a* and at least a portion of counterweight 38. The shield 40 is connected to the lower portion 22*d* of housing 22 and, in a preferred embodiment, is made integral therewith.

As further illustrated in FIGS. 1G–J, the pad assembly 28 preferably consists of a pad support 44, a first pad 28*a*, a second pad 28*b*, and a third pad 28*c*. The pads 28*a–c* are overlaid and connected to one another and to the pad support 44 by an adhesive (not shown) and, preferably, include a closed polyethylene pad, an ether foam pad, and a closed micro-cell polyethylene pad, respectively. The preferred pads 28*a–c* have a thickness of ¼", "and" respectively. In alternate embodiments, however, various types and sizes of pads may be used. For example, varying combinations of the above mentioned pads may be used in either a two pad configuration or in a single pad configuration, rather than a three pad configuration.

The pad support 44 has a generally planar disc portion 44*a* supporting a circular hub portion 44*b* extending upward from the center of the disc and an annular wall 44*c* extending upward from the disc portion 44*a* intermediate the edge of the disc portion 44*a* and hub portion 44*b*. A plurality of gusset members extend along the sides of the hub portion 44*b* down to the disc portion 44*a* (see FIGS. 1G and H). As mentioned above, the annular wall 44*c* is positioned intermediate the outer perimeter of the disc 44*a* and the hub portion 44*b* and is preferably located about two-thirds of the radial distance from the center of the disc 44*a* toward the perimeter of the disc 44*a*. Thus, the counterweight 38 rotates within the annular wall 44*c* of the pad support 44, and the annular wall 44*c* remains under cover of the shield 40. With such a configuration, the skirt member 40 and the annular wall 44*c* of the pad support 44 combine to prevent, or at least hinder, direct access to the counterweight 38.

The hub portion 44*b* of pad support 44 defines a hollow center region that houses bearings 46*a–b* and spacer 48. The bolt 42 extends through the central openings in the bearings 46*a–b* and the spacer 48 and is threaded into the second bore 38*b* of the counterweight 38. The first pad 28*a*, the second pad 28*b* and the third pad 28*c* also have central openings or passageways through which the bolt 42 passes in order to be threaded into the counterweight 38. The end of bolt 42 includes an enlarged head to secure the pad support 44, bearings 46*a–b* and spacer 48, to the tool 20. During operation, the pad assembly 28 will orbitally rotate about the z-axis of the tool (defined by the longitudinal axis of output shaft 32*a*) when the motor 32 drives the shaft 32*a* and the counterweight 38.

For maintenance purposes, at least one small opening or notch 44*d* may be defined by the annular wall 44*c* of the pad support 44 so that a hand tool or other instrument can be inserted into the interior region between the pad support 44 and the skirt member 40 to prevent the counterweight 38 from rotating while the bolt 42 is being unscrewed and removed from the counterweight 38. This enables the pad assembly 28 to be removed from the tool 20 for access to the counterweight 38 and other internal components (e.g., the motor shaft 32*a*, bearing 46*a*, etc.). Such access may be required to repair or replace parts, including the counterweight 38 and pad assembly 28 or those parts internal thereto.

The counterweight 38 includes a first horizontal portion 38*c*, which defines bores 38*a* and 38*b* of the counterweight 38. More particularly, the first horizontal portion 38*c* is generally rectangular in shape and cross-section and has bores 38*a–b* disposed therein between first and second ends of the structure. The first bore 38*a* is internally threaded for receiving the motor output shaft 32*a* and has a sleeve or collar extending upward from the top surface of the horizontal portion 38*c* in order to increase the length of the bore 38*a*. The second bore 38*b* is internally threaded for receiving the bolt 42 connecting the pad assembly 28 to the tool 20 and has a sleeve or collar extending downward from the bottom surface of the horizontal portion 38*c* in order to increase the length of the bore 38*b*. The lengthened bores 38*a* and 38*b* increase the amount of the shaft 32*a* and bolt 42 disposed therein, which subsequently strengthens the mechanical connection made between the counterweight 38 and shaft 32*a* and between counterweight 38 and bolt 42.

A second horizontal portion 38*e* is connected to the first horizontal portion 38*c* via a generally vertical interconnecting portion 38*d*. More particularly, the interconnecting portion 38*d* connects the second horizontal portion 38*e* such that it is generally parallel to the first horizontal portion 38*c*. Collectively, the connecting portion 38*d* and second horizontal portion 38*e* form a generally L-shaped structure. A second generally vertical portion 38*f* extends from the first horizontal portion 38*c* on the side opposite the interconnecting member 38*d*. Thus, the first and second end members 38*g* and 38*h* are located on opposite sides of the counterweight 38. The second end member 38*h* is generally rectangular in shape and is generally centered off of the end of the first horizontal portion 38*c*.

As illustrated in FIGS. 1A–J, the first handle 24 includes a pair of elongated members 24*a* and 24*b* which project outward from the rear portion 22*d* of the housing 22, near the top thereof, when the tool is assembled. More particularly, in the embodiment illustrated, the first and second side members 24*a* and 24*b* connect along the parting line 20*e* to form the handle 24. In a preferred form, the side members 24*a* and 24*b* are connected via a tongue-and-groove configuration and are secured together by screws or other fasteners which are inserted into recessed bores 24*c* located in the right side portion 24*b* of handle 24 and thread into internally threaded bores or post members 24*d* defined by the left side portion 24*a*.

The side members 24*a–b* of handle 24 have rounded end portions which are connected to the housing 22 in a manner that allows the handle to be moved with respect to the housing. In the form illustrated, the rounded end portions of side members 24*a–b* are connected to the housing in a tongue-and-groove configuration which allows the handle 24 to be pivoted from a first position wherein the handle is folded down adjacent the pad 28 or rear housing portion 22*b* to a position generally perpendicular to the z-axis of the power tool 20. More particularly, the rounded end portions of side member 24*a–b* have projecting members, such as walls 24*e–f*, which are inserted into guides, such as channels 22*h*–I. When assembled, the walls 24*e–f* prevent the handle 24 from pulling out of the housing 22, while the channels 22*h*–I allow the handle 24 to be rotated with respect to the housing 22. In the embodiment illustrated, the walls 24*e–f* extend about a majority of the rounded end portions perimeter and the recesses or channels 22*h*–I extend around a 360 radius to form a ring into which the walls 24*e–f* are inserted.

The handle assembly further includes an actuator, such as pushbutton 25, which is located generally adjacent the handle 24 and is operable to release a braking or locking mechanism so that the handle 24 may be adjusted into another position. In the embodiment illustrated, pushbutton 25 has first and second ends 25*a–b*, respectively, and is generally cylindrical in shape. The pushbutton 25 also has an annular wall 25*c* extending about a portion thereof. The annular wall 25*c* limits the amount the pushbutton 25 can travel both into and out of the opening 22*k* located in housing 22. More particularly, the annular wall 25*c* engages the inner surface of clam shell housing portion 20*c* to prevent the pushbutton 25 from being fully removed from the housing 22 through opening 22*k*. The annular wall 25*c* will also engage the outer surface of handle portion 24*a* to prevent the pushbutton 25 from being inserted further into the opening 22*k*.

Figure 2A:
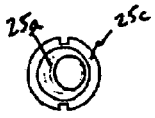
FIGS. 2A–B are front and side elevational views, respectively, of the actuator illustrated in FIG. 1A.
Figure 2B:
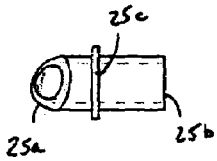
Figure 3A:
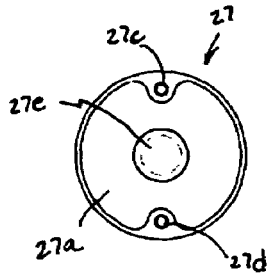
FIGS. 3A–B are front and side elevational views, respectively, of the locking member illustrated in FIG. 1A.
Figure 3B:
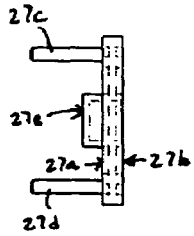
Figure 4:
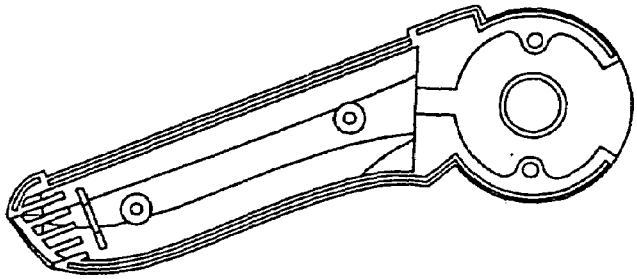
FIG. 4 is a side elevational view of the inner surface of the left handle housing illustrated in FIG. 1A.
Figure 5:
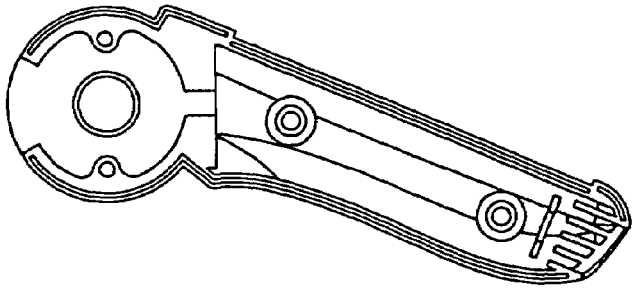
FIG. 5 is a side elevational view of the inner surface of the right handle housing illustrated in FIG. 1A.

As illustrated in FIGS. 2A–B, the annular wall 25*c* is located intermediate the ends 25*a–b* of the push button 25. End 25*a* of the push button 25 is beveled so as to create an angled opening which is complimentary to the opening 22*k* defined by housing 22. The edges of the beveled end 25*a* are rounded in order to make the pushbutton 25 more comfortable to operate.

The opposite end 25*b* of pushbutton 25 passes through large central openings defined by the rounded ends of handle portions 24*a–b* and into a braking or locking mechanism to cause the mechanism to disengage the handle so that it may be moved with respect to housing 22. More particularly, in the embodiment illustrated, pushbutton end 25*b* contacts and drives a lock member, such as locking plate or body 27, when the pushbutton 25 is depressed into opening 22*k*. In one form, body 27 includes a cylindrical disc having first and second sides 27*a–b*, respectively. The first side 27*a* of body 27 includes a pair of projections, such as post members 27*c–d*, extending from opposite ends thereof and has a cylindrical member 27*e* extending from its center.

The second side 27*b* of body 27 includes a cup-like recess 27*f* located in the middle thereof. More particularly, the cylindrical member 27*e* extending from first side 27*a* forms the bottom and part of the side walls of the cup-like recess 27*f* located in second side 27*b*. A resilient member, such as spring 29, has one end inserted into recess 27*f* and its other end inserted into a second cup-like recess 22*m* located in the inner surface of the clam shell housing portion 20*d*. When the tool is assembled, the spring 29 is compressed between the bottoms of the cup-like recesses 27*f* and 22*m* and biases the locking plate 27 away from clam shell housing portion 20*d* and towards the right side 24*b* of handle 24. If the post members 27*c–d* are aligned with any of the plurality of openings 22*n* located in the inner surface of clam shell housing portion 20*c*, a positive lock position has been reached and the spring 29 will urge the plate 27 and post members 27*c–d* into the openings 22*n* thereby locking the handle 24 into position. When the locking plate 27 is generally flush with the right handle portion 24*b*, the cylindrical member 27*e* extending from the first side 27*a* of locking plate 27 extends into the large opening defined by the right handle portion 24*b* and post members 27*c–d* extend through the small openings defined by the handle portions 24*a–b* and into the openings 22*n* defined by clam shell housing portion 20*c*.

In the embodiment illustrated, the eight openings 20*n* form four positive locking positions in which the handle 24 can be positioned in. It should be understood, however, that more or less openings 20*n* may be provided in order to offer the desired number of handle positions. For example, if the tool handle is desired to have three handle positions, six openings 22*n* may be provided. Alternatively, if the tool handle is desired to have five handle positions, ten openings may be provided. It should also be understood that in alternate embodiments, locking plate 27 may be provided with only one post member, rather than the two post members 27*c–d* illustrated. In the form illustrated in FIGS. 1A–J, two post members 27*c–d* are used in order to increased the strength of the handle and its connection to the housing 22 when placed in a positive lock position.

The handle assembly may also be configured to allow the handle 24 to be freely movable over a predetermined range of motion without the need to actuate the pushbutton 25. More particularly, in the embodiment illustrated in FIGS. 1A–J, the clam shell housing portion 20*c* includes two arcuate members 22*p–q* which allow the prevent the post members 27*c–d* from entering into an opening that would lock the handle 24 into position, and allow the handle to be freely moved (without the need to actuate the pushbutton) until a positive lock position has been reached. In the embodiment illustrated, the arcuate walls 22*p–q* allow the handle to be freely movable between the handle's initial, most compact, position (illustrated in FIG. 6C), and its first positive lock position (illustrated in FIG. 6D), which corresponds to the position the handle is in when the post members 27*b–c* are inserted into the holes 22*n* nearest the arcuate wall members 22*p–q*.

Thus, the range of motion allowed for in the freely movable state is determined by the distance the post members 27*b–c* travel until reaching the first openings 22*n* (or positive lock position). As such, the range of motion of the freely movable state can be increased by increasing the distance to the first openings 22*n*, or decreased by decreasing the distance to the first openings 22*n*. In alternate embodiments, a handle assembly with no freely movable state may be desired. If such is the case, the arcuate walls 22*p–q* may be replaced with additional openings 22*n* which correspond to positive lock positions for securing the handle 24 in place.

Figure 6A:
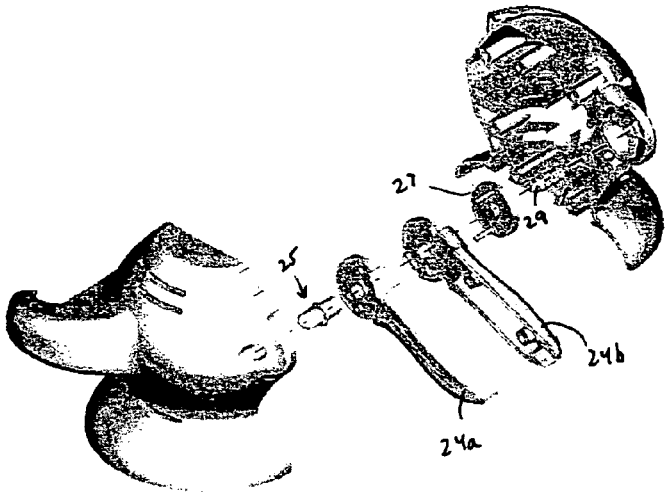
FIG. 6A is an exploded view of the handle assembly illustrated in FIG. 1A.
Figure 6B:
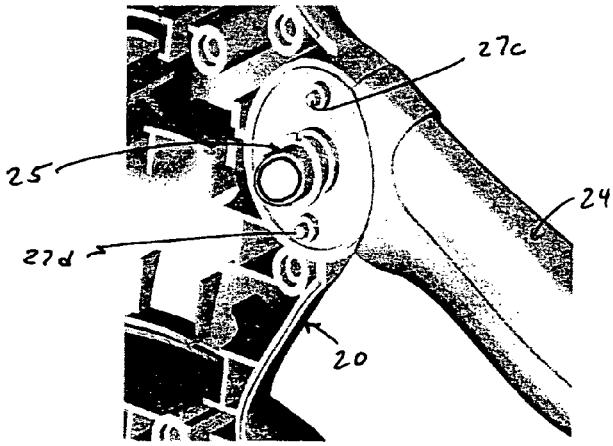
FIG. 6B is an enlarged view of the assembled handle illustrated in FIG. 1A, showing the assembled handle inserted into the right housing of the power tool and with the left housing of the power tool removed.

FIG. 6B illustrates the handle assembly with the locking plate 27 flush against the right handle portion 24*b*, the post members 27*c–d* in their fully inserted positions, and the actuator in its normally biased position. If the pushbutton 25 was depressed into the large openings defined by the handle members 24*a–b*, the pushbutton end 25*b* would push the locking plate 27 away from the handle 24 and towards the clam shell housing portion 20*d*. This would result in the spring 29 being compressed between the locking plate 27 and the clam shell housing portion 20*d* and in post members 27*c–d* retracting into the smaller openings defined by the handle portions 24*a–b*, thereby releasing the handle to be moved with respect to the housing 20.

Figure 6C:
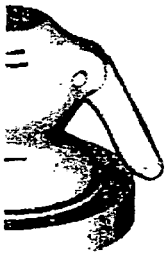
FIGS. 6C–G are perspective views of the handle assembly illustrated in FIG. 1A, showing the handle assembly in a plurality of different positions with respect to the power tool housing.
Figure 6D:
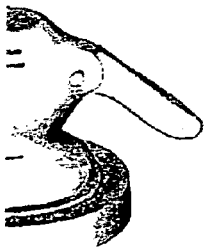
Figure 6E:
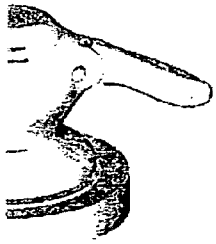
Figure 6F:
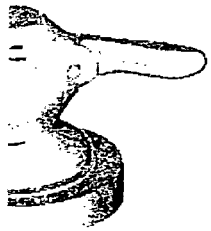
Figure 6G:
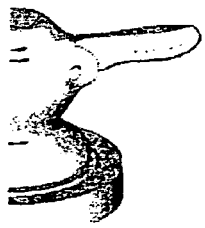
Figure 7A:
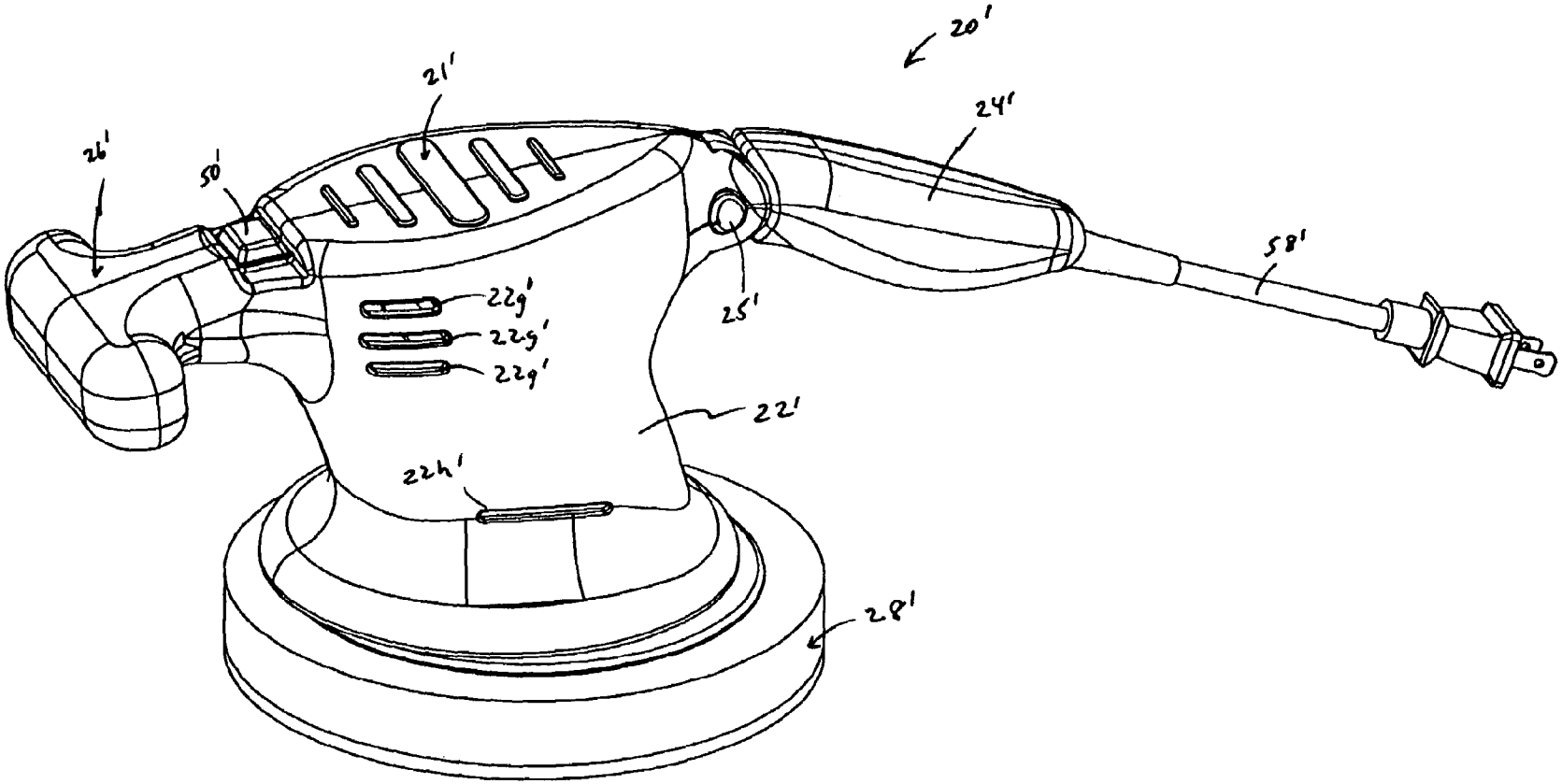
FIG. 7A is a perspective view of an alternate power tool embodying features of the present invention.
Figure 7B:
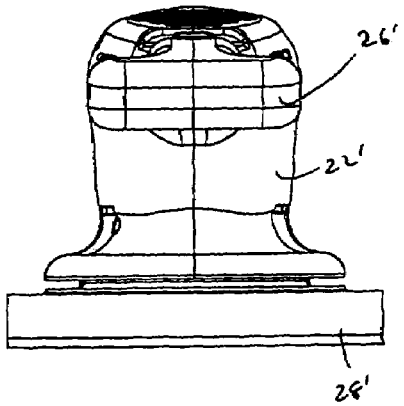
FIGS. 7B–C are front and rear elevational views, respectively, of the power tool of FIG. 7A.
Figure 7C:
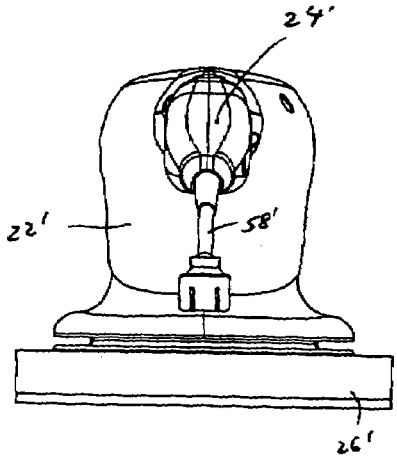
Figure 7D:
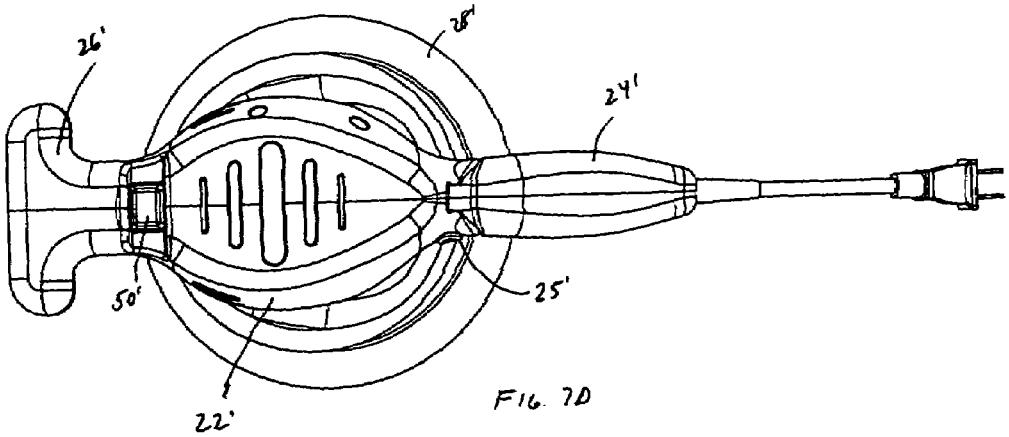
FIG. 7D is a plan view of the power tool of FIG. 7A.
Figure 7F:
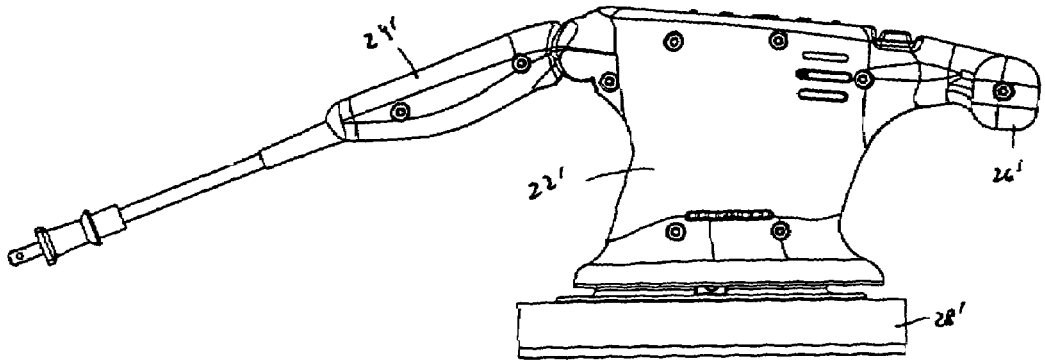
FIGS. 7E–F are left and right side elevational views, respectively, of the power tool of FIG. 7A.
Figure 7E:
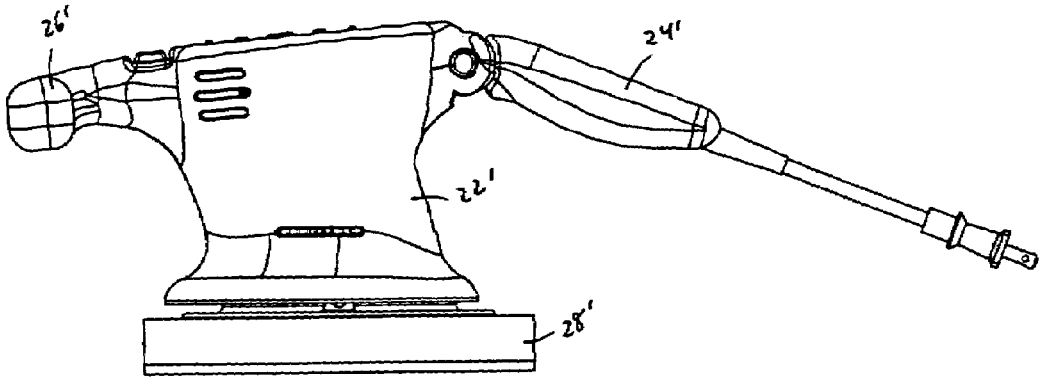

The position illustrated in FIG. 6C shows the handle assembly in a folded down, compact state, which makes the unit easy to store and easy to pack and ship. In a preferred form, the handle may be freely rotated from the position in FIG. 6C to the position in FIG. 6D, at which point the first positive locking position is reached. The handle may then be rotated from the position in FIG. 6D to the position in FIG. 6E by actuating pushbutton 25 and rotating the handle toward the position in FIG. 6E. The handle may then be rotated from the position in FIG. 6E to the position in FIG. 6F by actuating the pushbutton 25 and rotating the handle to the position of FIG. 6F. The handle may then be rotated from the position in FIG. 6F to the position in FIG. 6G by actuating the pushbutton 25 and rotating the handle to the position in FIG. 6F. Alternatively, an operator may actuate the pushbutton 25 at any time and when the handle is in any position and may move the handle to any of the positions illustrated and release the pushbutton 25. If the pushbutton is released when the handle is in a position illustrated in FIGS. 6D–G, the handle will be locked into position.

Referring now back to FIGS. 1A–J, the handle assembly may be made out of a variety of materials and in a variety of shapes. In the embodiment illustrated, the disc 27, (including posts 27*c–d*), is made from a metal, such as steel, and the pushbutton 25, handle portions 24*a–b* and housing portions 22 are made from molded plastic. As such, the openings defined by the handle portions 24*a–b* are designed to increase and/or maximize the amount of surface area between the handle portions 24*a–b* and the post members 27*c–d* so that the post members 27*c–d* are securely disposed in the handle and to prevent uneven ware on handle components. Furthermore, in the embodiment illustrated, the handle 24 has a generally rounded or oval-shape cross-section at any given point. The upper surface of the handle 24 is generally flat compared to the remainder of the contour, which, as shown by the lower surface 24*e* is generally arcuate to provide an operator with a more comfortable grip and to account for the differing hand sizes of operators.

The rear portion 22*b* of housing 22 defines an opening or socket within which a power switch 50 is disposed. In the embodiment illustrated in FIGS. 1A–G, the power switch 50 includes a rocker switch that is generally rectangular in shape and cross-section and has a malleable cover, such as a sealed rubber cover. The power switch 50 is located proximate to the handle 24 so that an operator can turn power on and off with the hand holding handle 24.

It should be understood, however, that in alternate embodiments other types of power switches may be used. For example, the power switch 50 may include a momentary on switch and/or a locking momentary on switch which can be temporarily locked in the "on" position. In one embodiment, a trigger switch may be provided which extends from below the handle 24. For example, a locking momentary on pushbutton, such as pushbutton switch HELI KP-D1 manufactured by Changzhou Create Electric Appliance Co. Ltd. of Changzhou, China, may be used. To accommodate such an actuator, one of the side portions 24*a–b* of first handle 24 may define an opening through which a lock member is disposed for selectively locking the momentary on switch into the "on" position. In a preferred embodiment, the operator may lock the power switch into the "on" position by pivoting the trigger into the "on" position, depressing a locking pushbutton disposed in the side of handle 24 to lock the trigger in the "on" position, and releasing the trigger. The locking pushbutton would prevent the trigger from being fully returned to its biased "off" position, thereby temporarily locking the power switch in the "on" state. The tool 20 may then be deactivated by pivoting (or squeezing) the trigger again toward the "on" position until the spring activated lock pushbutton disengages the trigger lock so that the trigger may be returned to its biased "off"position. In yet other embodiments, other power switches and features may be incorporated into the tool 20 as are known in the art.

As illustrated in FIGS. 1G–J, the rear portion or distal end of handle 24 includes a power cord 58 for supplying power to the tool 20 (i.e., for supplying power to the apparatus from a power supply external to the power tool). Preferably, the power cord 58 has two conductive and shielded wires and an outer insulator jacket (e.g., a double insulation wiring configuration). The rear handle 24, made up of side portions 24*a* and 24*b*, includes two semi-circular notches 60 located on each side portion 24*a–b* which cooperate with the rear of the handle 24 to form a strain relief 61 for the power cord 58. More particularly, the notches 60 form a rounded collar about a flange portion of the power cord's insulator jacket. This helps to prevent the power cord 58 from being separated from the handle 24 and power tool 20.

One end of the power cord 58 includes an electrical connector, such as male plug member 58*a*, which can be connected to various types of power supplies, either directly or via an extension cord (not shown). On the other end of the power cord 58, one wire is connected to electronic circuitry located within the tool 20, such as a terminal of a full wave rectifier 62 (FIG. 1G), which is fastened to the circuit board containing brushes 33*a–b*. The other wire is connected to a terminal of the power switch 50. A second terminal of the power switch 50 is electrically connected by a wire to a second terminal on the rectifier 62, and additional wiring electrically connects third and fourth terminals on the rectifier 62 to first and second terminals on motor 32, which are connected to the brushes 33*a–b* in order to complete the electrical circuit between the power supply, rectifier 62, motor 32 and power switch 50. Thus, when the tool 20 is connected to a power supply and actuator 50 is placed into the "on" position, power will be supplied to the motor 32 in order to drive the work element 28 connected to the tool 20. When the power switch 50 is placed into the "off" position, no power will be supplied to the motor 32, and the apparatus 20 will remain in an inoperative or de-active state.

In the alternate embodiment discussed above using the HELI KP-D1 switch, both wires may be connected to input terminals of the switch and output wires from the switch may be connected to the rectifier 62. Additional wires from the rectifier would then be electrically connected to the motor 32 in order to complete the electrical circuit between the power supply, rectifier 62, motor 32 and actuator 50. Thus allowing the tool 20 to be operated with a momentary on pushbutton switch rather than a push on-push off type switch. As mentioned above, it should be understood that alternate actuators and wiring schemes may be used in order to operate the power tool 20.

As illustrated in FIGS. 1A–J, the second handle 26 has a general bail handle configuration which projects outward from the front portion 22*a* or side portions 22*e–f* of the housing 22, or from each or a combination thereof, in order to provide the operator with a forward handle to facilitate an effective grip to help maintain control over the tool 20. More particularly, the first and second side portions 26*a* and 26*b* of handle 26 (see FIG. 1G–H) are connected by a third member 26*c* to form the second handle 26. The elongated member 26*c* and side portions 26*a–b* are secured together by fasteners, such as screws, which are inserted into bores defined by the side portions 26*a–b* and thread into internally threaded posts 26*d* extending from the elongated member 26*c*. Collectively the portions 26*a–c* and housing 22 define an aperture which allows an operator to grasp the forward handle 26 in a variety of positions. In the embodiment illustrated, the forward handle portions 26*a–c* are curved in a manner complimenting the curved surface of housing 22. Alternate embodiments of handle 26 are illustrated in U.S. Pat. No. 6,168,507, issued to McCracken on Jan. 2, 2001, and U.S. Pat. No. 6,499,172, issued to McCracken on Dec. 31, 2002, which are hereby incorporated herein by reference in their entirety.

As illustrated in FIGS. 1A–J, both the first and second handles 24 and 26 have outer elastomer surfaced grips 64 to facilitate enhanced gripping for control over the tool 20. In a preferred embodiment, the elastomer grips 64 are provided on the upper and side surfaces of handle 24 and encase the elongated portion 26*c* of handle 26 to facilitate enhanced gripping control over the power tool 20. The elastomer grip is preferably added by way of an injection overmolding process. More particularly, the handles 24 and 26 are preferably formed by a plastic injection molding process, which is later followed by injection of a grip layer material to form grip 64. A preferred material for the elastomer grip 64 is an elastomer/plastic blend, such as, for example, SANTOPRENE, which is a product of Advanced Elastomer Systems, L.P. of Akron, Ohio. The overmolded grip may be formed with a smooth outer surface or with a textured outer surface and provides a non-slip rubber (or rubber-like) gripping surface for the operator's hand to grasp. Preferably, the operator will grip the top surface of first handle 24 with his or her palm and wrap his or her thumb off to one side of the handle 24 and fingers off to the other side of the handle 24. In contrast, the operator will preferably grip the top surface of the elongated handle portion 26*c* with his or her palm and wrap his or her fingers around one side of the handle 26 and his or her thumb off to the other side of the handle 26. In alternate embodiments, additional portions of the handles 24 and 26 (or the entire surface of the handles) may be covered with an elastomer overmolding. For example, an overmolded grip portion may be included on the lower surface of first handle 24. Furthermore, in yet other embodiments, only one of the handles 24 or 26 may include the elastomer grip 64.

It should be understood that other materials may be used for the overmolding portions. For example, other thermal plastic elastomers or elastomer/plastic blends, such as rubber, nylon, butyl, EPDM, poly-trans-pentenarmer, natural rubber, butadiene rubber, SBR, ethylene-vinyl acetate rubber, acrylate rubber, chlorinated polyethylene, neoprene and nitrile rubber, may also be used for the overmolded grip 64. Another material which may be used for the overmolding is HERCUPRENE, which is manufactured by the J-Von Company of Leominster, Mass.

It should also be understood that alternate embodiments of the apparatus 20 may be provided with no elastomer overmolding whatsoever. For example, the tool 20 may be provided with a simple smooth plastic handle, or a textured plastic handle, created from a plastic injection molding process. More particularly, the overmolding may be replaced with a textured surface, such as Rawal #MT-11605, a mold texturization process provided by Mold-Tech/Rawal of Carol Stream, Ill. Similarly, other mold texturization processes may be used to create a variety of textured surfaces.

Turning now to FIGS. 7A–E, there is illustrated an alternate embodiment of tool 20 embodying features in accordance with the present invention. In this embodiment, the tool 20 includes a different housing shape and a different forward handle 26. For convenience, features of alternate embodiments illustrated in FIGS. 7A–E that correspond to features already discussed with respect to the embodiments of FIGS. 1–6 are identified using the same reference numeral in combination with an apostrophe (') merely to distinguish one embodiment from the other, but otherwise such features are similar.

More particularly, the tool in FIGS. 7A–E, hereinafter 20', includes a generally T-shaped forward handle 26' extending from the front of housing 22'. The handle 26' preferably has a rectangular cross section and slopes slightly forward or down and away from the front of housing 22'. A recessed portion is provided in the upper surface of handle 26', adjacent the housing 22', and includes an opening or socket within which the power switch 50' is mounted. The rear handle 24' and internal configuration of tool 20' are similar to that discussed above with respect to FIGS. 1–6 and operate in a similar manner.

Although certain example methods and apparatus have been described herein, the scope of coverage of this patent is not limited thereto. On the contrary, this patent covers all methods, apparatus, and articles of manufacture fairly falling within the scope of the appended claims either literally or under the doctrine of equivalents.

What is claimed is:

1. A power tool adjustable handle assembly comprising:

a housing;

a handle connected to the housing and being movable between a plurality of positions with respect to the housing, the handle having a first gripping portion;

a lock member associated with either the movable handle or the housing;

a mating member associated with the other of the movable handle and the housing which cooperates with the lock member to lock the handle in a position; and an actuator separate from the handle and movable between a lock position wherein the lock member and mating member cooperate to lock the handle in position and an unlock position wherein the handle is movable with respect to the housing, the actuator being normally biased in the lock position and depressable into the unlock position.

2. A power tool adjustable handle assembly according to claim 1 wherein the housing has front and rear portions and the handle extends from the rear portion of the housing and provides a rearward gripping surface for an operator to grasp.

3. A power tool adjustable handle assembly according to claim 2 further comprising a second handle extending from the housing and providing a forward gripping surface for the operator to grasp.

4. A power tool adjustable handle assembly according to claim 3 wherein the second handle extends around the front portion of the housing creating a first gripping aperture in front of the housing.

5. A power tool adjustable handle assembly according to claim 1 wherein the plurality of positions about which the handle may be moved include at least one positive locking position wherein the lock member and mating member automatically cooperate to lock the handle into position and at least one alternate position wherein the handle is freely movable over a predetermined range of motion.

6. A power tool adjustable handle assembly according to claim 1 wherein the housing comprises first and second housing portions which cooperate with the movable handle to allow the handle to be moved between the plurality of positions.

7. A power tool adjustable handle assembly according to claim 6 wherein at least one of the housing portions and the movable handle have a projection and the other of the at least one of the housing portions and the movable handle has a recess which cooperates with the projection to guide the handle movement between the plurality of positions.

8. A power tool adjustable handle assembly according to claim 1 wherein the lock member is a body associated with the movable handle and the mating member is a recess associated with the housing, the body having at least one projection which extends into the recess when the lock member and mating member cooperate to lock the handle in position.

9. A power tool adjustable handle assembly according to claim 8 wherein the body is movable between an insert position wherein the projection is inserted into the recess to lock the handle in position and a remove position wherein the projection is removed from the recess to allow the handle to be moved between the plurality of positions, the disc being moved between the insert and remove positions by movement of the actuator between the lock and unlock positions, respectively.

10. A power tool adjustable handle assembly according to claim 9 further including a spring for biasing the body into the insert position, the spring being located intermediate the housing and the body and allowing for a sufficient amount of compression to move the body from the insert position to the remove position.

11. A power tool adjustable handle assembly as claimed in claim 1 wherein the first gripping portion has an enhanced texture surface to assist an operator in gripping the handle.

12. A power tool adjustable handle assembly as claimed in claim 1 wherein the housing has a top and further includes a pad extending from at least a portion of the top of the housing and providing a surface upon which the housing may be rested.

13. A power tool adjustable handle assembly as claimed in claim 11 wherein the pad has a plurality of elastomeric ridges which extend from the top and provide frictional surfaces upon which the housing may be rested.

14. A power tool adjustable handle assembly according to claim 1 wherein the handle is movable between a stored position wherein the handle is folded down thereby compacting the size of the power tool and a use position wherein the handle is folded up thereby increasing the size of the power tool.

15. A power tool adjustable handle assembly comprising:

a housing having front and rear portions;

a motor mounted in the housing;

a work element for working on a workpiece being mounted below the bottom of the housing and being driven by the motor; and a first handle being connected to the housing and movable between a plurality of positions relative to the housing, the handle extending from the rear portion of the housing and having a first gripping portion, wherein either the rear portion of the housing or the first handle has a projection and the other of the rear portion of the housing and the first handle has a recess which cooperates with the projection to guide the handle movement between the plurality of positions.

16. A power tool adjustable handle assembly as claimed in claim 15, further comprising a second handle being connected to the housing and extending in front of the front portion of the housing and having a second gripping portion.

17. A power tool adjustable handle assembly as claimed in claim 16, wherein at least one of the first and second gripping portions includes an enhanced texture surface for an operator to grip the tool.

18. A power tool adjustable handle assembly according to claim 17 wherein the enhanced textured surface is an elastomer surface.

19. A power tool adjustable handle assembly according to claim 18 wherein the elastomer surface is an elastomer injected overmolding.

20. A power tool adjustable handle assembly according to claim 16 wherein the second handle includes a contoured lower surface to enhance gripping by an operator's hand.

21. A power tool adjustable handle assembly according to claim 16 wherein the second handle is T-shaped and extends from the front portion of the housing, the handle providing s contoured projections to enhance gripping by an operator's hand.

22. An electrically-powered polisher having a pad and a motor to drive the pad, the polisher comprising:

a housing for containing a motor to drive a pad located below the housing, the housing having first and second portions; and a handle connected to a rear portion of the first and second housing portions and being movable between a plurality of positions with respect to the housing, wherein the first and second housing portions cooperate with the handle to allow the handle to be moved between the plurality of positions.

23. A power tool adjustable handle comprising:

a housing;

a handle extending from the housing and being movable between a plurality of positions with respect to the housing;

a detent associated with either the handle or the housing;

at least one detent receiver associated with the other of the movable handle and the housing which cooperates with the detent to lock the handle in at least one of the positions; and an actuator movable between a lock position, wherein the detent and the at least one detent receiver cooperate to lock the handle in at least one of the positions, and an unlock position, wherein the handle is movable relative to the housing, the actuator being normally biased in the lock position and moveable into the unlock position.

24. A power tool adjustable handle according to claim 23 wherein the housing further comprises front and rear portions and the handle extends at least from the rear portion of the housing.

25. A power tool adjustable handle according to claim 24 wherein the handle further comprises a rearward gripping surface for an operator to grasp.

26. A power tool adjustable handle according to claim 24 further comprising a second handle extending from the housing and including a forward gripping surface for an operator to grasp.

27. A power tool adjustable handle according to claim 26 wherein the second handle extends from at least the front portion of the housing so to define a first gripping space in front of the housing.

28. A power tool adjustable handle according to claim 23 wherein the detent includes at least a first position in the at least one detent receiver plurality to lock the handle into at least one of the plurality of positions and at least a position wherein detent is retained free from the at least one detent receiver such that the handle is freely movable over a predetermined range of positions.

29. A power tool adjustable handle according to claim 28 wherein the at least one detent receiver includes at least two detent receivers and the actuator operates between the lock position in which the detent is received in at least one of the at least two detent receivers and the unlock position in which the detent is free from the at least two detent receivers such that the handle is freely moveable over a predetermined range of positions.

30. A power tool adjustable handle according to claim 23 wherein the detent is associated with the handle and the at least one detent receiver is associated with the housing.

31. A power tool adjustable handle assembly according to claim 30 wherein the detent is movable between an insert position wherein the detent is received in the at least one detent receiver to lock the handle in one of the plurality of positions and a removed position wherein the detent is free from the at least one detent receiver to allow the handle to be moved between the plurality of positions, the detent being moved between the insert and removed positions by movement of the actuator between the lock and unlock positions, respectively.

32. A power tool adjustable handle according to claim 31 further including a spring for biasing the detent into the insert position, the spring being able to compress sufficiently to allow the detent to move from the insert position to the removed position.

33. A power tool adjustable handle as claimed in claim 25 wherein the reward gripping surface has an enhanced texture surface to assist an operator in gripping the handle.

34. A power tool adjustable handle as claimed in claim 23 wherein the housing has a top portion configured to provide a surface upon which the housing may be rested.

35. A power tool adjustable handle as claimed in claim 34 wherein the top portion further includes resilient portion extending therefrom upon which the housing rests.

36. A power tool adjustable handle as claimed in claim 35 wherein the pad has a plurality of elastomeric ribs which extend therefrom upon which the housing may rest.

37. A power tool adjustable handle according to claim 23 wherein the handle is movable between a stored position wherein the handle is folded down thereby compacting the size of the power tool and a use position wherein the handle is folded up thereby increasing the size of the power tool.

38. A power tool adjustable handle comprising:

a housing;

a handle extending from the housing and being movable between a plurality of positions with respect to the housing;

a detent associated with either the handle or the housing;

at least one detent receiver associated with the other of the movable handle and the housing which cooperates with the detent to lock the handle in at least one of the positions; and an actuator movable between a lock position, wherein the detent and the at least one detent receiver cooperate to lock the handle in at least one of the positions, and an unlock position, wherein the handle is movable relative to the housing, the actuator being normally biased in the lock position and moveable into the unlock position, wherein the housing comprises first and second housing portions which cooperate with the movable handle to allow the handle to be moved between the plurality of positions.

39. A power tool adjustable handle according to claim 38 wherein at least one of the first and second housing portions and the handle has a projection and the other of the at least one of the first and second housing portions and the handle defines a recess which cooperates with the projection to guide the handle movement between the plurality of positions.

* * * * *